United States Patent [19]

Morrison

[11] Patent Number: 5,010,823

[45] Date of Patent: Apr. 30, 1991

[54] LINEAR PROPELLING SEPARATOR

[75] Inventor: Peter A. Morrison, Laurel, Md.

[73] Assignee: The United States of America as represented by the Secretary of the Navy, Washington, D.C.

[21] Appl. No.: 553,499

[22] Filed: Jul. 13, 1990

[51] Int. Cl.[5] ..... F42B 1/02

[52] U.S. Cl. ..... 102/307; 102/309; 102/476

[58] Field of Search ..... 102/307, 308, 309, 476, 102/478

[56] References Cited

U.S. PATENT DOCUMENTS 3,248,072 4/1966 Schimmel ..... 264/1

4,641,581 2/1987 Weickert et al. ..... 102/307

4,951,572 8/1990 Bocker et al. ..... 102/476

FOREIGN PATENT DOCUMENTS 3523569 7/1985 Fed. Rep. of Germany ..... 102/307

*Primary Examiner*—Peter A. Nelson

*Attorney, Agent, or Firm*—Kenneth E. Walden

[57] ABSTRACT

This invention relates to an elongated flexible housing containing coextensive explosive and propellant charges. The housing is adapted to be attached to a structure to be severed and the parts separated. The explosive charge is a shaped-charged for first severing the structure into two parts. The propellant charge separates the severed parts one from another.

7 Claims, 1 Drawing Sheet

LINEAR PROPELLING SEPARATOR

BACKGROUND OF THE INVENTION

It has long been required in missile and space applications to remotely separate one part of a casing or structure from another. Such separations are usually accomplished by explosives which cut the structure. Missile casing separation commonly employs explosive bolts or shaped-charges, which may be assisted by mechanical devices for spatially separating the cut parts. An arrangement for cutting a casing by use of a linear shaped-charge is disclosed in U.S Pat. No. 3,185,090. An improved arrangement is taught in U.S. Pat. No. 3,244,104 where an annular explosive charge is mounted within a missile body and separated therefrom to provide an air space to thermally insulate the explosive from the housing. Many arrangements are employed for severing the casing of a missile, or for severing or deforming pipes such as used in oil wells. See, for example, U.S. Pat. Nos. 2,797,892; 3,053,182; and 4,354,433.

The prior art fails, however, to teach the use of a combination explosive and propellant for sequentially cutting a structure and spatially separating the cut parts.

SUMMARY OF THE INVENTION

In summary, the device disclosed herein is an explosive shaped-charge and a propellant. The device comprises an elongate linear housing containing a coextensive shaped-charge and a propellant material. It is adapted to be formed or placed inside or about a structure with the shaped-charge "V" facing the structure for severing it upon detonation. The propellant material is subsequently ignited to propel the part to which the housing is attached away from the other part.

It is, therefore, an object of the invention to provide a linear device containing both a linear shaped-charge for initially severing a structure, such as a casing, and a linear propellant charge for subsequently separating the severed parts.

Objects of the invention will become more apparent from the detailed description which follows hereinafter when considered in conjunction with the several drawing figures to which like reference numerals denote like parts throughout the several views.

BRIEF DESCRIPTION OF THE DRAWING FIGURES

FIG. 1 is a perspective cross-sectional view of the elongate housing illustrating the positions of the shaped-charge and the propellant.

FIG. 1*a* is an alternate form of the elongate housing shown in cross-section.

DETAILED DESCRIPTION OF THE PREFERRED EMBODIMENT

Figure 1:
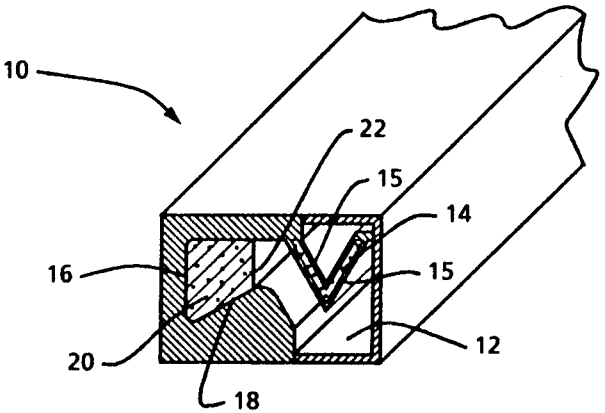
Figure 1A:
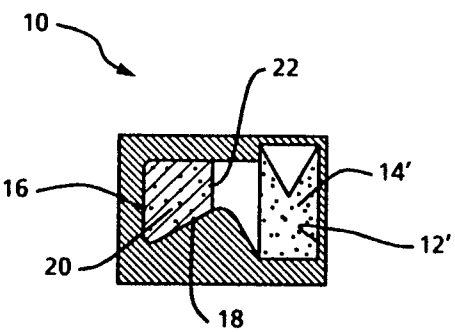

There is provided a preferably flexible elongate housing containing a generally coextensive explosive charge and a generally coextensive propellant charge, each adapted to perform a function in sequence for first severing a structure to which the housing is attached, and then spatially separating the severed parts. Referring first to FIG. 1 of the drawings, the invention is illustrated in a cross-sectional perspective view wherein a generally rectangular elongate housing, identified by numeral 10, is formed to contain internal recesses or cavities running throughout its length. No particular material is identified as preferable for the housing except that it should be sufficiently strong to retain the charges, yet flexible or pliable enough to allow a length to be manually shaped to conform generally to the shape or contour of a structure to be explosively severed. Means (not illustrated) may be provided to secure housing 10 to structure to be severed. FIG. 1 best illustrates the internal recess of the elongate housing. One cavity 12 is formed to receive a V-shaped explosive charge 14. This shaped-charge may be of numerous configurations, all of which being designed to concentrate an explosive charge along one front. The explosive material of shaped-charge 14 may fill a V-shaped form 15 provided in extruded housing 10. In the FIG. la alternative arrangement, shaped-charge 14' may be formed separately and set into place along one side of cavity 12' of housing 10 as illustrated. On the other side of housing 10 is formed a blind cavity 16 having a reduced size throat entrance at 18 which defines a nozzle which faces shaped-charge 14 or 14'. Cavity 16 is filled with propellant 20. A partition of ignitable primer material 22 is provided across throat 18 in adjacency with propellant 20 and faces the side of shaped-charge 14 or 14'. Upon detonation of shaped-charge 14 or 14', hot fragments produced thereby ignite primer 22, which in turn ignites propellant 20.

Figure 2:
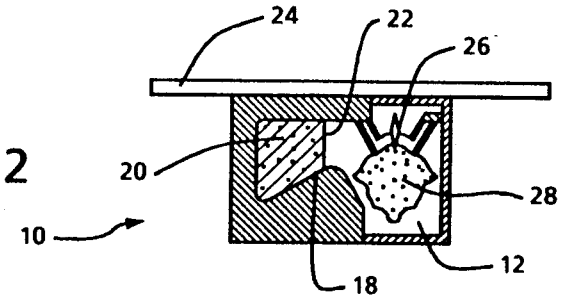
FIG. 2 illustrates in cross-section the housing adjacent a structure to be severed with the shaped-charge just beginning to detonate.

FIGS. 2–5 illustrate the sequence of events that occur upon detonation of the shaped-charges. FIG. 2 shows elongate housing 10 in secured adjacency with structure 24 which is to be severed. Housing 10 may be secured to structure 24 by numerous mechanical means or by magnetic attractions, all of which are known in the art. As illustrated in FIG. 2, shaped-charge 14 has just detonated. A jet 26 of cutting force is projecting toward structure 24, and gases of detonation and hot fragment 28 are expanding into cavity 12.

Figure 3:
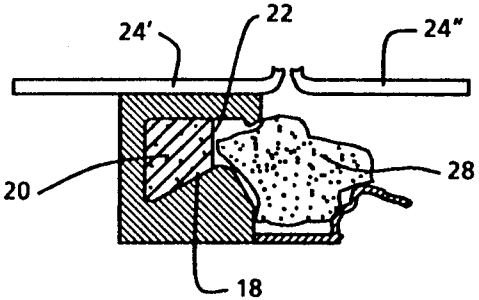
FIG. 3 illustrates in cross-section the housing after the shaped-charge has severed the structure wall and hot fragments and gases have expanded to disrupt a portion of the housing.

FIG. 3 represents the action of the shaped-charge just microseconds after that which is illustrated in FIG. 2. Structure 24 has been severed by jet 26 into two parts 24' and 24'', and expansion gases and hot fragments 28 have continued to expand, completely filling cavity 12 and rupturing the housing wall of cavity 22. Hot gases and fragments 28 at the other side are illustrated as just approaching partition 22 at throat entrance 18 to cavity 16. This partition, in outward adjacency with propellant 20, is formed of ignitable primer material 22 adapted to be initiated from hot fragment 28 to ignite propellant 20.

Figure 4:
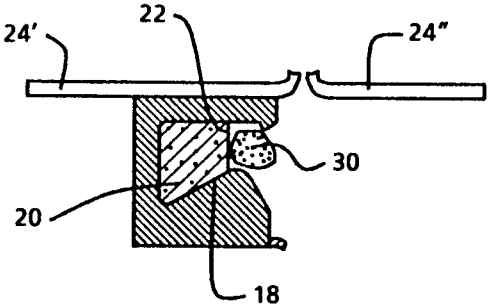
FIG. 4 illustrates initial ignition of the propellant charge by a primer initiated by hot fragments generated from detonation of the shaped-charge.

As illustrated in FIG. 4, subsequent ignition of propellant 20 via primer 22 has just commenced as indicated by expanding gases 30. It will be noted in FIGS. 3 and 4 that parts 24' and 24'', although severed, remain in substantially their same position because no forces have yet acted to separate them.

Figure 5:
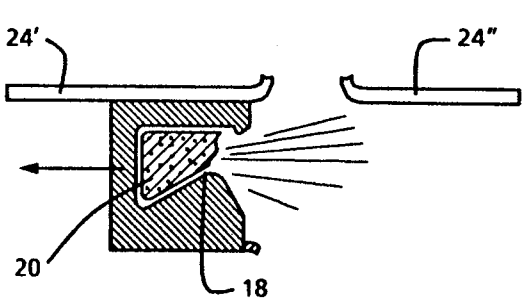
FIG. 5 illustrates burning propellant providing thrust to separate parts of the severed structure.

As propellant 20 continues to burn, its gases expand through restricted throat opening or nozzle 18 to cause a reactive force as indicated by the arrow on housing 10 to propel part 24' away from part 24'' as indicated in FIG. 5.

The elongate housing as described herein has numerous uses, particularly in military and space technology where one part of a structure is to be severed and subsequently separated from another part. The cutting is by explosion taking place over a linear extent, and the separation is accomplished by force applied along a continuous nozzle for even thrust. Initiation of the cutting and separating actions may be accomplished by remote control over a considerable distance.

It will be understood that elongate housing 10 is preferable formed of a plastic or deformable material and have communicating cavities or recesses to receive the explosive and propellant charges coextensive therewith. The housing may be formed by an extrusion process to contain these continuous cavities. The housing, being deformable, can be physically brought into proximity to a structure to be severed. That part of housing 10 containing the propellant charge is the part that must be secured to structure 24.

Numerous other modifications and variations of the present invention are possible in light of the foregoing teachings. It is, therefore, to be understood that within the scope of the appended claims the invention may be practiced otherwise than as specifically described.

What is claimed is:

1. A device for use in severing a structure and spatially separating the severed parts, comprising:

an elongate housing adapted to be secured in adjacency to a structure to be severed;

said elongate housing having cavities extending generally coextensive throughout the length thereof;

an outwardly facing shaped explosive charge located in one of the housing cavities and adapted upon detonation to explosively sever a structure in its path; and, a propelling charge located in another cavity of the housing which cavity has a throat opening defining a propulsion nozzle in communication with the one cavity and facing transversely to the direction of the outwardly facing shaped-charge;

whereby, upon detonation of the shaped-charge, the structure is severed, and, by-products of detonation of the shaped-charge ignite the propelling charge for spatially separating the severed parts.

2. The invention according to claim 1 wherein the elongate housing is flexible and adapted to be conformed to the structure to be severed.

3. The invention according to claim 1 further defined by a partition of ignition primer material disposed across the nozzle throat for igniting the propelling charge by hot fragments from the shaped explosive charge.

4. The invention according to claim 2 further defined by a partition of ignition primer material disposed across the nozzle throat for igniting the propelling charge in the another cavity initiated by hot fragments of detonation from the shaped explosive charge.

5. An elongate flexible housing containing a generally coextensive shaped explosive charge facing outwardly therefrom for severing a structure lying in its explosive path;

said flexible housing adapted to be conformed to the general shape of a structure to be severed and attached thereto;

said flexible housing further containing a propellant charge located in a blind cavity generally coextensive with the elongate housing and having a reduced throat entrance defining an nozzle terminating in the vicinity of the shaped-charge and facing transversely to the shaped explosive charge explosive path;

whereby detonation of the shaped explosive charge severs the structure, and hot fragments of combustion ignite the propellant charge in the blind cavity for generating a force at the nozzle in a direction transverse to the line of severance for separating the parts of the severed structure.

6. The invention according to claim 5 further defined by ignition material located in the nozzle throat for aiding igniting of the propellant in the blind cavity by hot fragment from the shaped explosive charge.

7. The invention according to claim 6 wherein the ignition material is in the form of a partition lying across the nozzle throat in adjacency with the propellant material.

* * * * *